US006265834B1

(12) United States Patent
Lin

(10) Patent No.: US 6,265,834 B1
(45) Date of Patent: Jul. 24, 2001

(54) TUBULAR STRING OF CHRISTMAS LIGHTS

(76) Inventor: Mei-Lu Lin, No.56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/586,485

(22) Filed: Jun. 1, 2000

(51) Int. Cl.[7] ..... H05B 37/00
(52) U.S. Cl. ..... 315/185 S; 362/240; 362/249
(58) Field of Search ..... 315/185 S, 71; 362/240, 249

(56) References Cited

U.S. PATENT DOCUMENTS 4,991,071 * 2/1991 Braasch ..... 315/185 S
5,655,830 * 8/1997 Ruskouski ..... 362/240
6,039,458 * 3/2000 Coates, Jr. et al. ..... 362/249

* cited by examiner

*Primary Examiner*—Don Wong
*Assistant Examiner*—Jimmy Vu

(57) ABSTRACT

A tubular string of Christmas lights includes a transparent hose, an arcuate strip disposed into the hose having a pair of electrical wires integrated therein and a pair inlets at each end, a plurality of Christmas lights disposed into the hose and alternately connected to the electrical wire through a pin with barb at free end a plug having a pair of blades at one end made engageable into the inlets of the electrical wires and a pair of socket at the other end for engaging within the blades of an additional plug. The tubular string of the Christmas lights can be cut into different length to cope with the requirement of the user and can be connected together by the plugs.

9 Claims, 9 Drawing Sheets

(2-2)

(6-6)

TUBULAR STRING OF CHRISTMAS LIGHTS

BACKGROUND OF THE INVENTION

The present invention relates to the Christmas lights and more particularly to a tubular string of the Christmas lights which is convenient to manufacture and can be cut into different length to cope with the requirement of the user.

Previously, people dried to dispose one or several strings of the Christmas lights into a transparent hose to form a tubular string of the Christmas lights in order to protect the lights from external water or damagement. However, if any one of the lights inside the hose is damaged, the whole string of the lights may be failed and is difficult to repair. A typical tubular string of the Christmas lights 10 is therefore available as shown in FIGS. 1 to 3. This type of the Christmas lights comprises a transparent hose 11, an arcuate strip 12 disposed into the hose 11, two bunches of copper wires 13 and 14 integral with the arcuate strip 12 and parallel extending along the length of the strip 12, a plurality of the Christmas lights 15 and 16 spacedly disposed into the hose 11 and alternately connected with the single wires 131 from the bunch 13 or 141 from the bunch 14, a plurality of intermediate wires 151 and 161 which connect the lights 15 and 16 into a string, a plug 17 connected to one end of the hole 11 having a pair of blades 171 and 172 respectively engageable with the bunches of wires 13 and 14 and a socket 18 connected to the other end of the hose 11 having a pair of outlet respectively engageable with the bunch of wires 13 and 14.

This type of tubular string of the Christmas lights has an advantage that it can be cut into different length to cope with the requirement of the site to which it decorates. However, it has also a great disadvantage of difficulty to manufacture. Because, the single wires 131 and 141 must be regularly drawn away from inside the areuate strip 12 and then welded with lights respectively this job is very wearisome and wastes time and manpower.

SUMMARY OF THE PRESENT INVENTION

The present invention has a main object to provide a tubular string of the Christmas lights which is readily to manufacture.

Another object of the present invention is to provide a tubular string of the Christmas lights which can be cut into different length to cope with the site to which it decorates.

Further object of the present invention is to provide a tubular string of the Christmas lights which the hose can be variable to provide versatility to the user.

The present invention will become more fully understood by reference to the following detailed description thereof when read in conjunction with the attached drawings.

DETAILED DESCRIPTION OF THE PREFERRED EMBODIMENT

Figure 1:
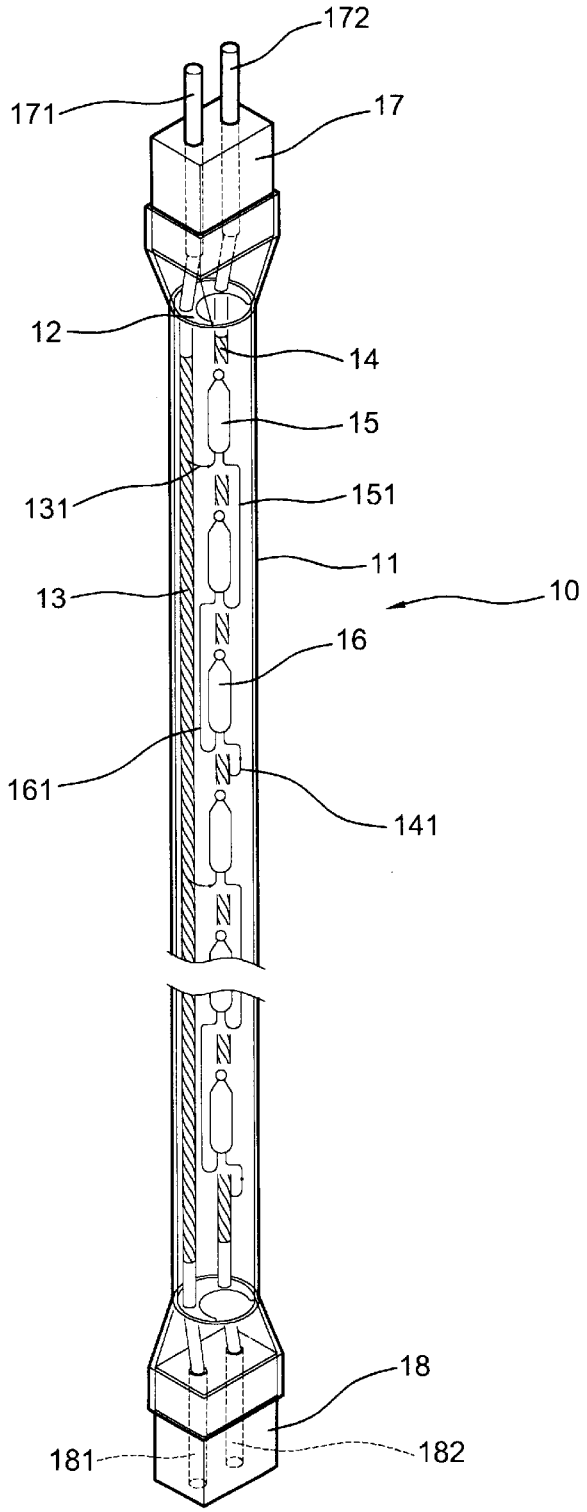
FIG. 1 Prior Art
FIGS. 1 to 3 are the sectional view of a tubular string of Christmas lights according to a prior art.
Figure 2:
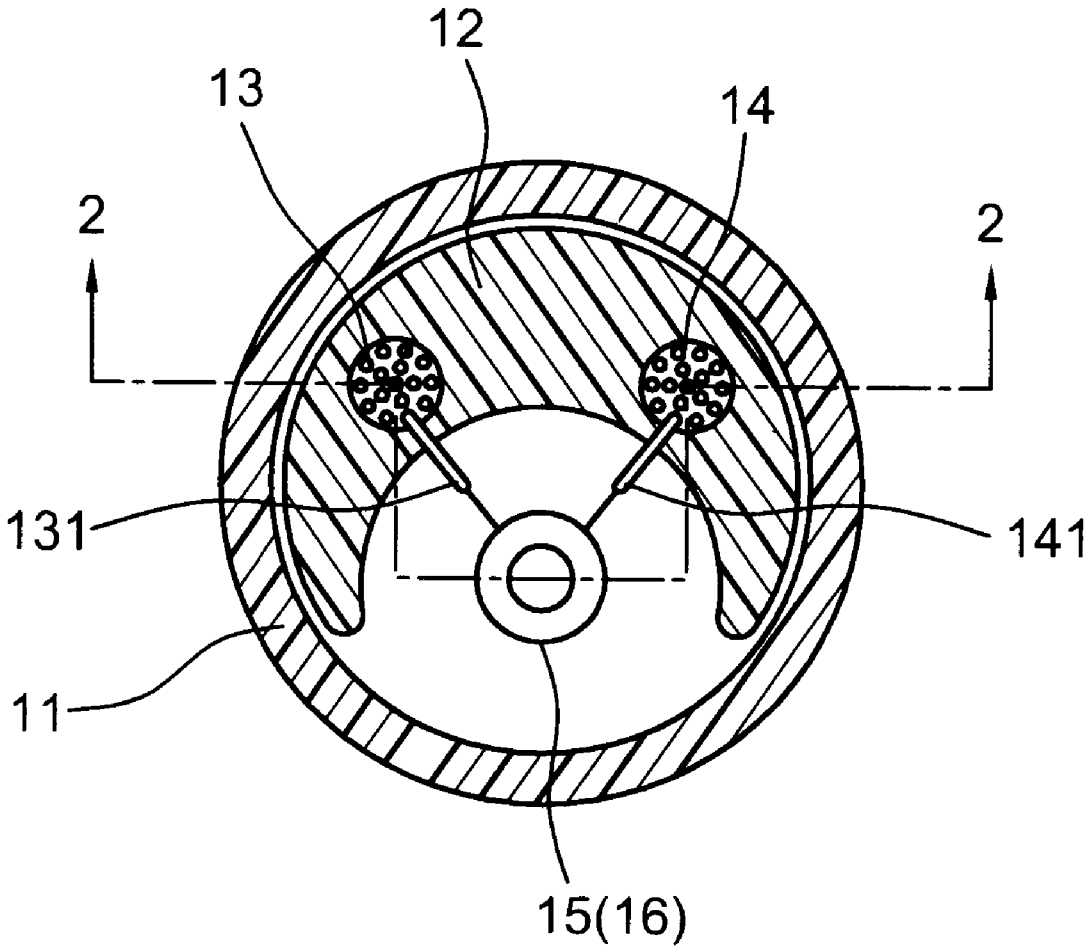
FIG.2 Prior Art
Figure 3:
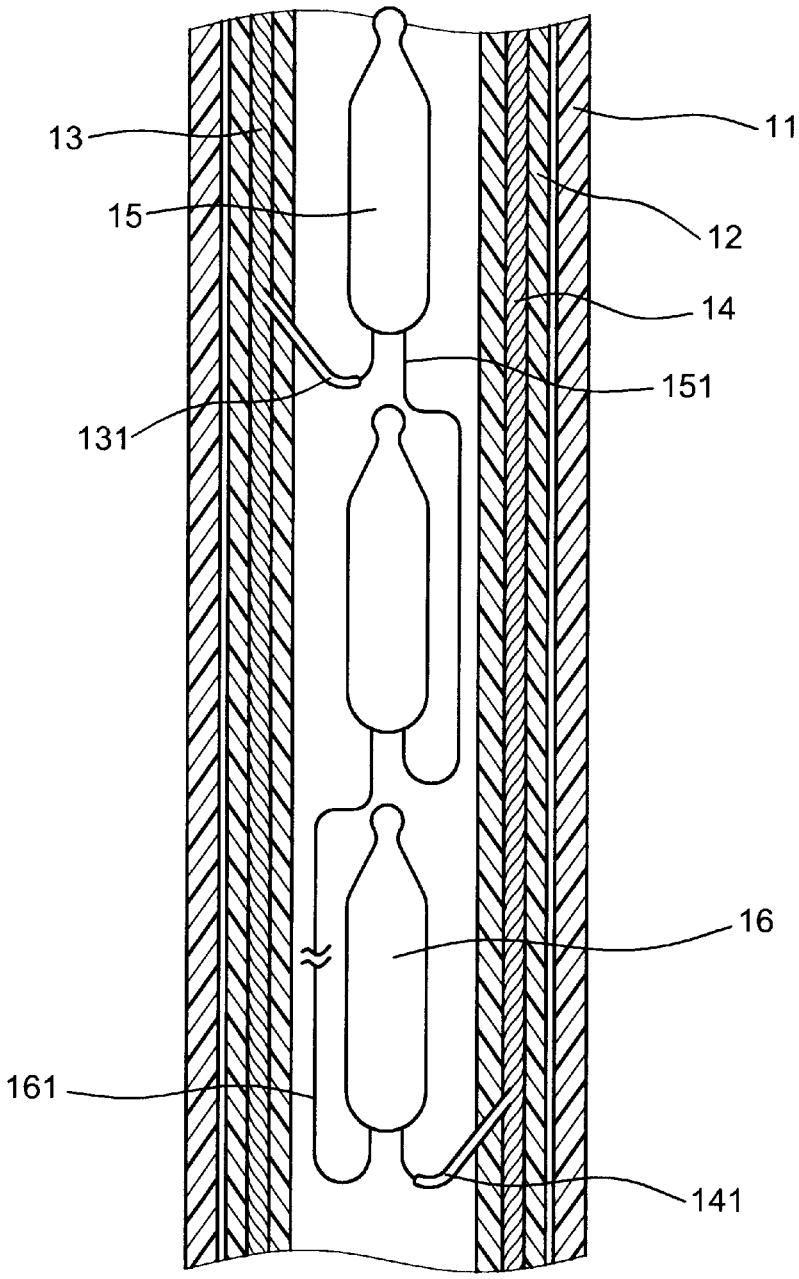
FIG.3 Prior Art
Figure 4:
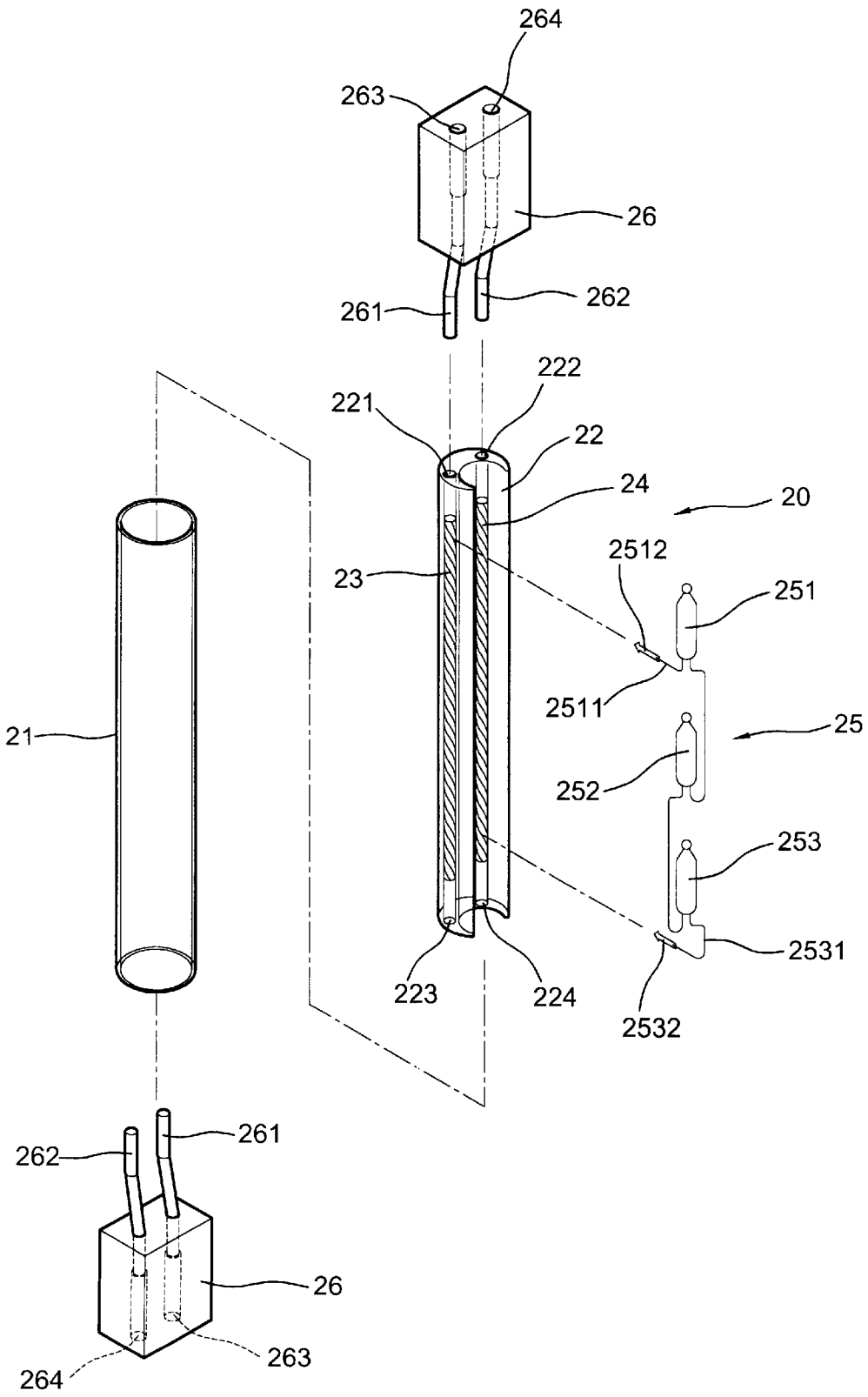
FIG. 4 is an exploded perspective view to a preferred embodiment of the tubular string of Christmas lights according to the present invention.
Figure 5:
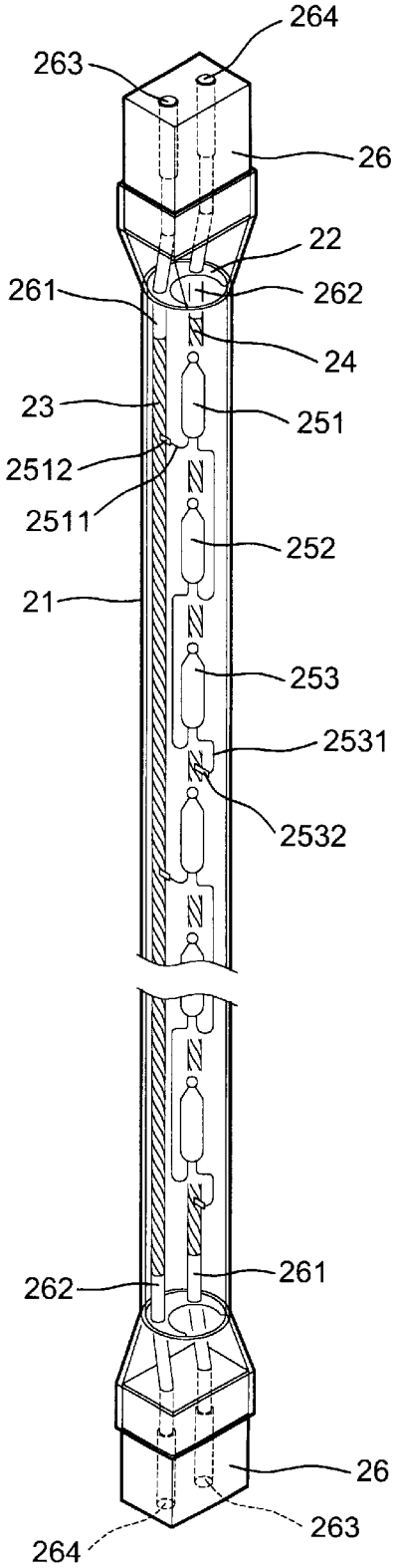
FIG. 5 is an elevational view to show an assembly of FIG. 4.
Figure 6:
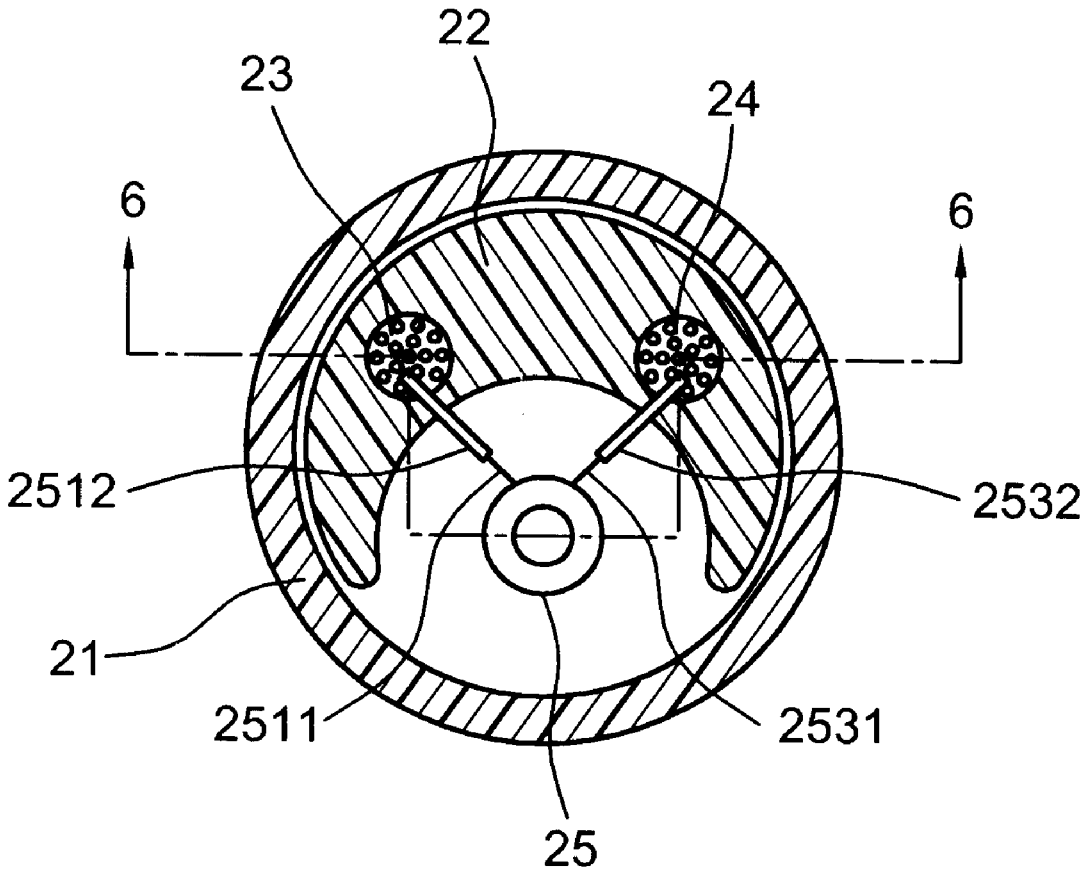
FIG. 6 is a sectional view taken along line 5—5 of FIG. 5.
Figure 7:
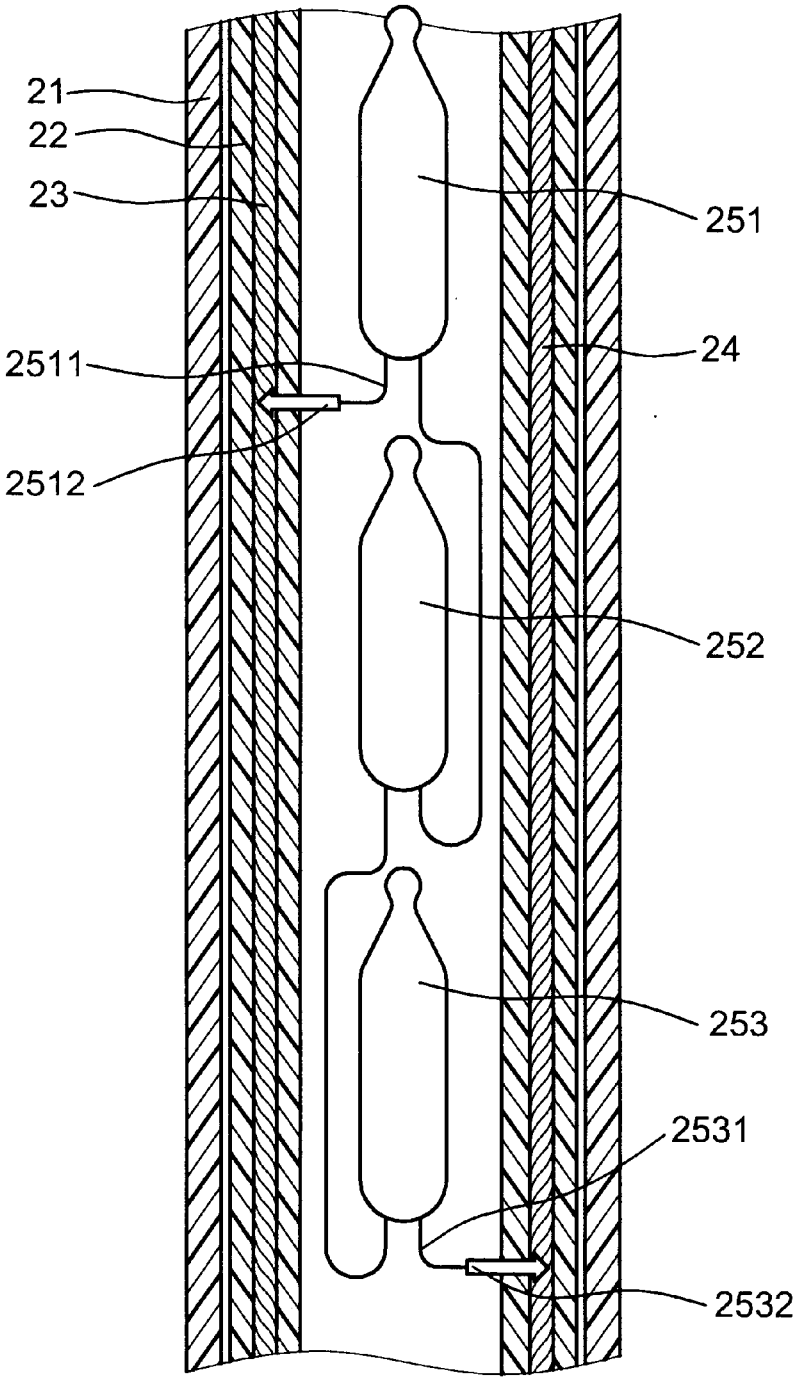
FIG. 7 is a sectional view taken along line 6—6 of FIG. 6.

With reference to FIGS. 4 to 7 of the drawings, the tubular string of Christmas lights 20 of the present invention comprises generally a transparent hose 21 which may be in different color, an arcuate strip 22 made of flexible plastic material disposed into the hose 21 having the length equal to the hose 21, a pair of wires 23 and 24 integral with the arcuate strip 22 and parallel extending along the length of the strip 22 each including an inlet 221, 222, 223 and 224 at two ends and a string of the Christmas lights 25 disposed into the hose 21 and alternately connected with the wires 23 or 24. The manner of connection of the lights with the wires 23 and 24 is such that a first light 251 connects to the wire 23 via a first lead-in wire 2511 and a pin 2512 which has a tip point with barb, a last light 253 connects to the wire 24 via a second lead-in wire 2531 and a pin 2532 and a second light 252 respectively connects to the first and second lights 251 and 253 via a pair of the first and second lead-in wires. Actually the lights between the first and the last lights 251 and 253 are alternately connected to the wires 23 or 24 as shown in FIG. 5 via the first or second lead-in wires and the pins which are stably engaged within the wires 23 or 24 because of the barbs.

A plug 26 includes a pair of blades 261 and 262 insertible into the inlets 221 and 222 or 223 and 224 at two ends of the arcuate strip 22 a pair inlets 263 and 264 for insertion of the blades 261 and 262 of an additional plug 26 or the blades from an external power source. A sleeve 27 is used to sleeve on the free end of the hose 21 to support the plug 26.

This arrangement provides that several tubular strings of lights can be connected by the plug 26, or a long string of lights is cut into different length at the spot begand the lights 251 or 253 for instance, the plug 26 is still useful to connect them to supply the electricity.

Figure 8:
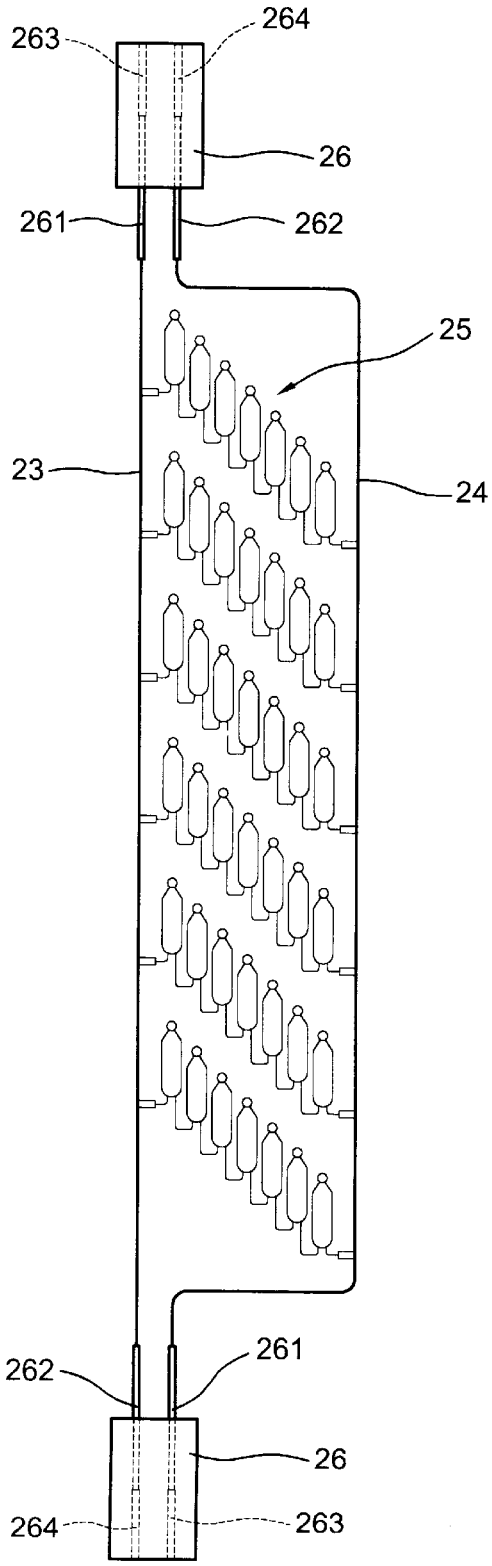
FIG. 8 is a plane view to show a tubular string of Christmas lights in which the lights are increased in number.

FIG. 8 shows that if a huge hose is used, the lights 25 can be arranged to row by row and each row contains several lights 25.

Figure 9:
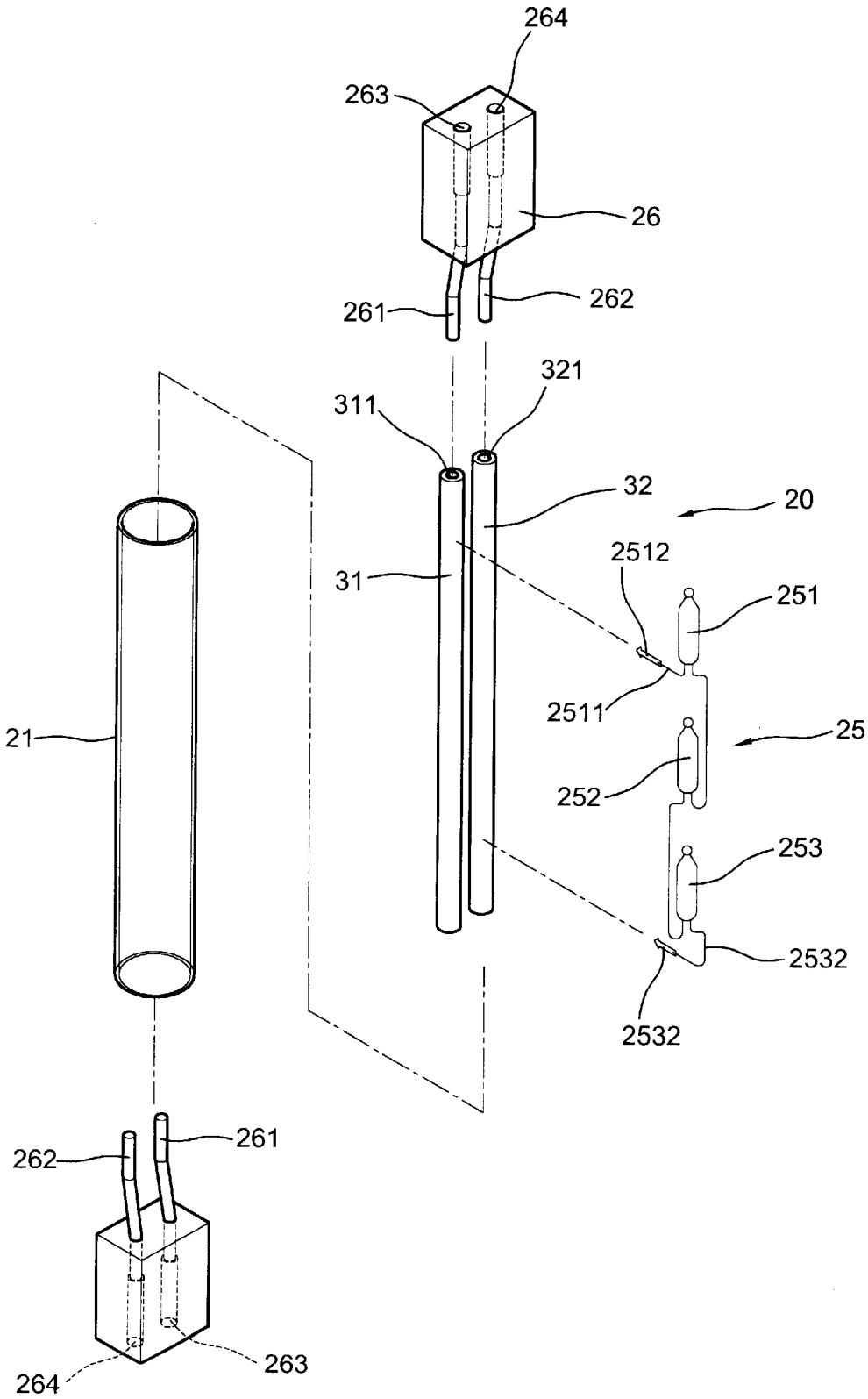
FIG. 9 is an exploded perspectively to show an alternate embodiment of the tubular string of Christmas lights of the present invention.

Referring to FIG. 9, an alternative embodiment of the present invention is provided. In this embodiment the structure and functions are mostly similar to the above embodiment described in FIGS. 4–7, and the above discussions are applicable in the most instances. The only different is that a pair of cords 31 and 32 are adapted instead of the arcuate strip 22 and the wires 23 and 24. The cords 31 and 32 each has an inlet 311 and 321 at two ends for insertion of the blades 261 and 262 of the plug 26 therein for connecting the tubular strings of lights and for supplying the electricity to the lights 25.

Accordingly, the tubular string of Christmas lights of the present invention can prevent cold weather, external water and/or external damagement.

The specification relating to the above embodiment should be construed as exemplary rather than as limitative of the present invention, with many variations and modifications being readily attainable by a person of average skill in the art without departing from the sprit or scope thereof as defined by the appended claims and their legal equivalents.

I claim:

1. A tubular string of Christmas lights comprising:

a transparent hose having two opening ends;

an arcuate strip disposing into the hose from one of the opening ends thereof and having a pair of first and second electrical wires integral with the strip and parallel extending along the length thereof, each including an inlet at two ends;

a plurality of Christmas light spacedly disposed into the hose from one of the opening ends thereof and having a first lead-in wire pierced into the first electrical wire through a pin at free end thereof and a second lead-in wire pierced into the second electrical wire through a pin at free end thereof;

a plug having a first and a second end, a pair of blades parallel extending outward from the first end thereof and engageable within the inlets of the first and second electrical wires including a sleeve wrapped thereon, and a pair of sockets parallel extending inward from the second end thereof for engaging within the blades of an additional plug.

2. The tubular string as recited in claim 1 wherein said hose in different color.

3. The tubular string as recited in claim 1 wherein said pin each has a barb at free end.

4. The tubular string as recited in claim 1 wherein said lights connect themselves with a first or a second lead-in wire.

5. The tubular string as recited in claim 1 wherein said light inside a huge hose can be arrange in rows.

6. A tubular string of Christmas lights comprising:

a transparent hose having opening ends;

a pair first and second electrical wires disposing into the hose from one of the opening ends and extending along the length thereof each having a pair of inlets in two ends;

a plurality of Christmas lights spacedly disposed into the hose from one of the opening ends thereof and having a first lead-in wire pierced into the first electrical wire through pin at free end thereof and a second lead-in wire pierced into the second electrical wire through a pin at free end thereof;

a plug having a first and a second end, a pair of blades parallel extending outward from the first end and engageable within the inlets of the first and second electrical wires including a sleeve wrapped thereon and a pair sockets parallel extending inward from the second end thereof for engaging with the blades of an additional plug.

7. The tubular string as recited in claim 6 wherein said hose in different color.

8. The tubular string as recited in claim 6 wherein said pin each has a bard at free end.

9. The tubular string as recited in claim 6 wherein said lights connect themselves with a first or a second lead-in wire.

* * * * *